US010676917B2

(12) United States Patent
Espinosa

(10) Patent No.: US 10,676,917 B2
(45) **Date of Patent: *Jun. 9, 2020**

(54) HOLDER AND CONCRETE ANCHOR ASSEMBLIES

(71) Applicant: CETRES HOLDINGS, LLC, Jackson, WY (US)

(72) Inventor: Thomas M Espinosa, Snohomish, WA (US)

(73) Assignee: CETRES HOLDINGS, LLC, Jackson, WY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/263,973

(22) Filed: Jan. 31, 2019

(65) Prior Publication Data

US 2019/0161959 A1 May 30, 2019

Related U.S. Application Data

(60) Continuation of application No. 15/057,948, filed on Mar. 1, 2016, now Pat. No. 10,202,753, which is a division of application No. 13/959,799, filed on Aug. 6, 2013, now Pat. No. 9,303,399.

(60) Provisional application No. 61/679,985, filed on Aug. 6, 2012.

(51) Int. Cl.

| | |
|---|---|
| ***E04B 1/41*** | (2006.01) |
| ***E04G 15/04*** | (2006.01) |
| ***E04G 21/18*** | (2006.01) |

(52) U.S. Cl.

CPC ..... *E04B 1/4121* (2013.01); *E04B 1/4114* (2013.01); *E04B 1/4128* (2013.01); *E04B 1/4135* (2013.01); *E04G 15/04* (2013.01); *E04G 21/185* (2013.01); *E04B 1/4157* (2013.01)

(58) Field of Classification Search

CPC .... E04B 1/4121; E04B 1/4135; E04B 1/4128; E04B 1/4114; E04B 1/4157; E04B 9/18; E04G 15/04; E04G 21/185; F16B 37/00

See application file for complete search history.

(56) References Cited

U.S. PATENT DOCUMENTS

| | | | |
|---|---|---|---|
| 991,517 | A | 5/1911 | Kennedy |
| 1,045,562 | A | 11/1912 | Kennedy |
| 1,185,765 | A | 6/1916 | Brooks |
| 1,264,189 | A | 4/1918 | Keator |

(Continued)

FOREIGN PATENT DOCUMENTS

| | | |
|---|---|---|
| WO | 2010/090736 | 8/2010 |
| WO | 2010/090748 | 8/2010 |

OTHER PUBLICATIONS

Chainring Construction Products LLC, www.ptanchor.com, Copyright 2009 Home, PT Anchor, Concept and Cut Sheet pages.

*Primary Examiner* — Adriana Figueroa

(74) *Attorney, Agent, or Firm* — Shlesinger, Arkwright & Garvey LLP

(57) ABSTRACT

A concrete anchor assembly includes a housing including a lower opening and a side wall; a flange portion extending from the housing; a ramp surface extending upwardly around the lower opening; a split body disposed over the lower opening, the split body including a bottom surface engaging the ramp surface, the split body including a threaded opening. The housing includes a gap between the split body and the side wall. A compressed spring forces the split body toward a bottom of the ramp surface.

20 Claims, 11 Drawing Sheets

(56) References Cited

U.S. PATENT DOCUMENTS 1,447,515 A 3/1923 Miller
1,940,545 A 12/1933 Holmes
2,689,987 A 9/1954 Berger
3,157,215 A * 11/1964 Zahodiakin ..... F16B 37/0857 411/267
3,157,966 A 11/1964 Sherburne
3,224,591 A 12/1965 Sawyer
3,391,514 A 7/1968 Hall, Jr.
3,405,497 A * 10/1968 McNair ..... E04B 1/4121 52/699
3,426,816 A * 2/1969 McIntire, Jr. ..... F16B 21/00 411/108
3,443,351 A 5/1969 Michio
3,509,670 A 5/1970 Boll et al.
3,514,917 A 6/1970 Merrill, Sr.
3,517,470 A 6/1970 Luebkeman
3,540,762 A 11/1970 Dunlap
3,579,938 A 5/1971 Hanson
3,782,061 A 1/1974 Minutoli et al.
3,867,804 A 2/1975 Wilson
3,884,004 A 5/1975 Douma et al.
3,927,497 A 12/1975 Yoshinaga et al.
3,935,685 A 2/1976 Howlett
4,169,569 A 10/1979 Riegler et al.
4,195,709 A 4/1980 Gianotti et al.
4,211,048 A * 7/1980 Naka ..... E04B 1/4121 411/427
4,239,489 A 12/1980 Ellmas et al.
4,250,681 A 2/1981 Helderman
4,287,807 A 9/1981 Pacharis et al.
4,325,575 A 4/1982 Holt et al.
4,378,187 A * 3/1983 Fullerton ..... B62D 25/147 411/237
4,408,940 A 10/1983 Fischer
4,650,276 A 3/1987 Lanzisesra et al.
4,812,096 A 3/1989 Peterson
4,945,704 A 8/1990 Brown, Jr.
5,081,811 A 1/1992 Sasaki
5,085,547 A 2/1992 Vanotti
5,118,237 A * 6/1992 Wright ..... F16B 31/02 411/14
5,205,690 A 4/1993 Roth
5,375,384 A 12/1994 Wolfson
5,378,100 A * 1/1995 Fullerton ..... F16B 37/0857 411/267
5,468,105 A * 11/1995 Iwamoto ..... E04B 1/4121 411/433
5,613,816 A * 3/1997 Cabahug ..... F16B 37/0857 411/267
5,641,256 A 6/1997 Gundy
5,653,078 A * 8/1997 Kies ..... E04B 1/4121 52/698
5,653,563 A 8/1997 Ernst et al.
5,740,651 A 4/1998 Vanotti
5,772,372 A 6/1998 Lins et al.
5,957,644 A 9/1999 Vaughan
6,033,169 A * 3/2000 Bettger ..... F16B 37/0857 411/267
6,135,687 A 10/2000 Leek et al.
6,161,339 A 12/2000 Cornett et al.
6,195,949 B1 3/2001 Schuyler
6,240,697 B1 * 6/2001 Thompson ..... E04B 1/4121 52/698
6,309,158 B1 * 10/2001 Bellinghausen ..... F16B 5/0208 411/107
6,341,452 B1 1/2002 Bollinghaus
6,350,093 B1 2/2002 Petersen et al.
6,513,300 B1 2/2003 James
6,904,728 B2 6/2005 Stutts
7,093,400 B1 8/2006 Thompson et al.
7,144,530 B2 12/2006 Ward et al.
7,150,132 B2 12/2006 Commins
7,174,679 B1 2/2007 Mueller
7,296,382 B2 11/2007 Sack
7,416,375 B2 * 8/2008 Virdee ..... F16B 37/0857 411/267
7,422,404 B2 * 9/2008 Kitamura ..... F16B 37/0857 411/267
7,445,192 B2 11/2008 Gridley et al.
7,744,322 B2 * 6/2010 Taneichi ..... F16B 37/0857 411/267
7,752,824 B2 7/2010 Brown et al.
7,766,299 B2 8/2010 Titus et al.
7,946,086 B2 5/2011 Hammer et al.
7,971,411 B2 7/2011 Commins
8,051,615 B2 * 11/2011 Mathews ..... F16G 11/106 403/78
8,136,318 B2 3/2012 Espinosa
8,257,004 B2 * 9/2012 Smith ..... F16B 37/0857 403/109.5
8,590,247 B2 * 11/2013 Cooke ..... F16B 21/02 52/125.1
8,708,629 B2 * 4/2014 Smith ..... F16B 39/32 411/267
2002/0037205 A1 * 3/2002 Taneichi ..... F16B 37/0857 411/267
2002/0189175 A1 12/2002 Lancelot et al.
2005/0055897 A1 3/2005 Commins
2010/0290859 A1 11/2010 Noce et al.
2011/0041449 A1 2/2011 Espinosa
2011/0041450 A1 2/2011 Espinosa
2011/0192111 A1 8/2011 White et al.
2014/0026515 A1 1/2014 Espinosa

* cited by examiner

FIG. 17
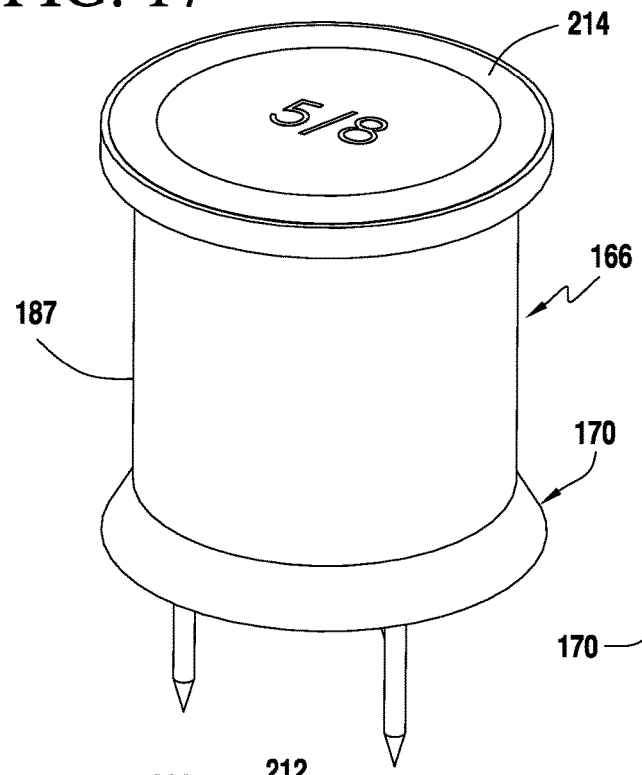
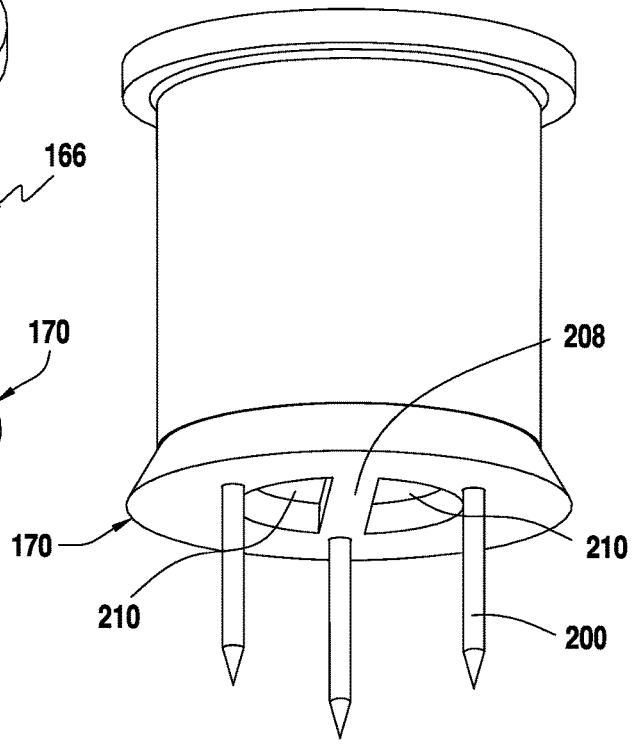
FIG. 18
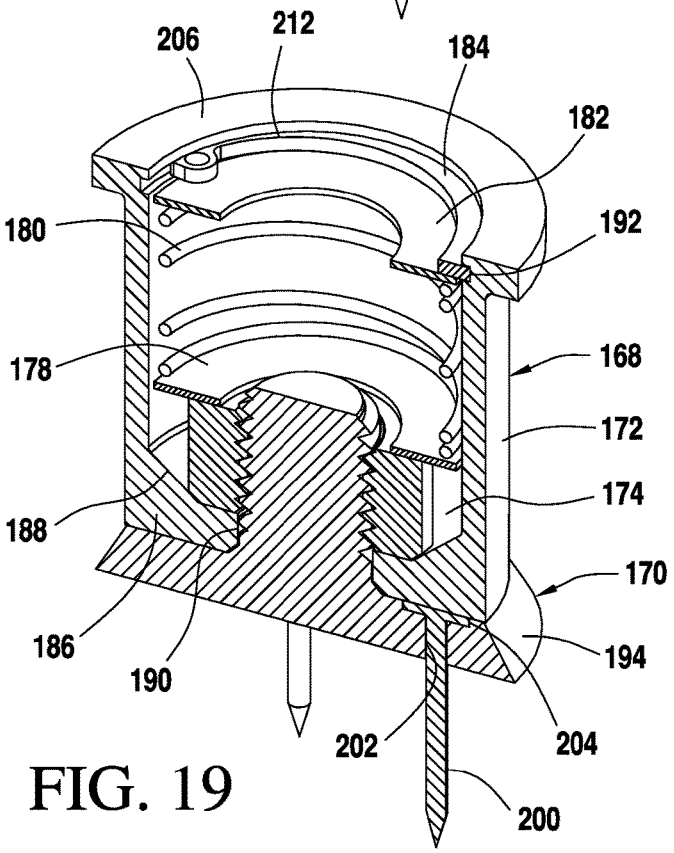
FIG. 19
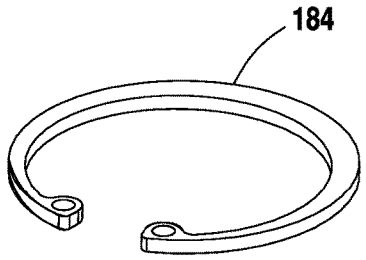
FIG. 20

HOLDER AND CONCRETE ANCHOR ASSEMBLIES

RELATED APPLICATIONS

This is a continuation of application Ser. No. 15/057,948, filed Mar. 1, 2016, which is a division of application Ser. No. 13/959,799, filed Aug. 6, 2013, which is a nonprovisional of Provisional Application Ser. No. 61/679,985, filed Aug. 6, 2012, all of which applications are incorporated herein by reference.

FIELD OF THE INVENTION

The present invention is generally directed to holders for concrete anchors for positioning the anchors on a concrete form surface prior to pouring concrete and concrete anchor assemblies including holders.

SUMMARY OF THE INVENTION

The present invention provides a holder for a concrete anchor to be embedded in concrete, comprising base portion; a first sleeve portion vertically disposed above the base portion; post portions including vertical openings, the post portions including respective top edges for providing a shoulder to engage the nail heads when the nails are installed in the vertical openings.

The present invention also provides a concrete anchor assembly for being embedded in concrete, the assembly comprising a holder; and an anchor body held by the holder, the anchor body including a rod portion and a head portion. The holder includes a sleeve portion and a base portion, the sleeve portion being vertically disposed above the base portion. The holder includes vertical openings and top edge. Nails are disposed in the respective vertical openings, the nails extending through the base portion. The nails include respective nail heads extending over and engaging the top edge. The head portion of the anchor body extends laterally from the rod portion, the head portion including an underside in direct contact with the nail heads.

The present further provides a concrete anchor assembly, comprising a housing having a top opening, the housing including a bottom wall with a bottom opening; the bottom wall including a ramp surface extending upwardly and away from the bottom opening; and a split nut disposed on the bottom wall and over the bottom opening. A spring is biased to force the split nut toward a bottom of the ramp surface.

The present invention also provides a concrete anchor assembly, comprising a housing including a lower opening and a side wall; a flange portion extending from the housing; a ramp surface extending upwardly around the lower opening; a split body disposed over the lower opening, the split body including a bottom surface engaging the ramp surface, the split body including a threaded opening; the housing including a gap between the split body and the side wall; and a spring to force the split body toward a bottom of the ramp surface.

The present invention also provides a concrete anchor assembly, comprising an anchor body including a rod portion and a head portion; the head portion extending laterally from said rod portion, the head portion including a threaded bore; and the rod portion including an internally threaded bore, the rod portion including an outside thread.

BRIEF DESCRIPTION OF THE DRAWINGS

FIG. 17 is a top perspective view of another embodiment of a concrete anchor assembly embodying the present invention.

FIG. 18 a bottom perspective view of FIG. 17.

FIG. 19 is a perspective longitudinal cross-sectional view of FIG. 17.

FIG. 20 is a perspective view of a C-shaped spring clip used in the concrete anchor assembly of FIG. 19.

DETAILED DESCRIPTION OF THE INVENTION

A concrete anchor assembly 2 embodying the present invention is disclosed in FIGS. 1-4. The concrete anchor assembly 2 is embedded in concrete during a concrete pour. After the concrete has cured, the concrete anchor assembly 2 is used to connect to a threaded rod for supporting a load. An illustration of manner of use involving other concrete anchors is disclosed in U.S. application Ser. No. 13/424,082, filed on Mar. 19, 2012, hereby incorporated by reference.

Figure 3:
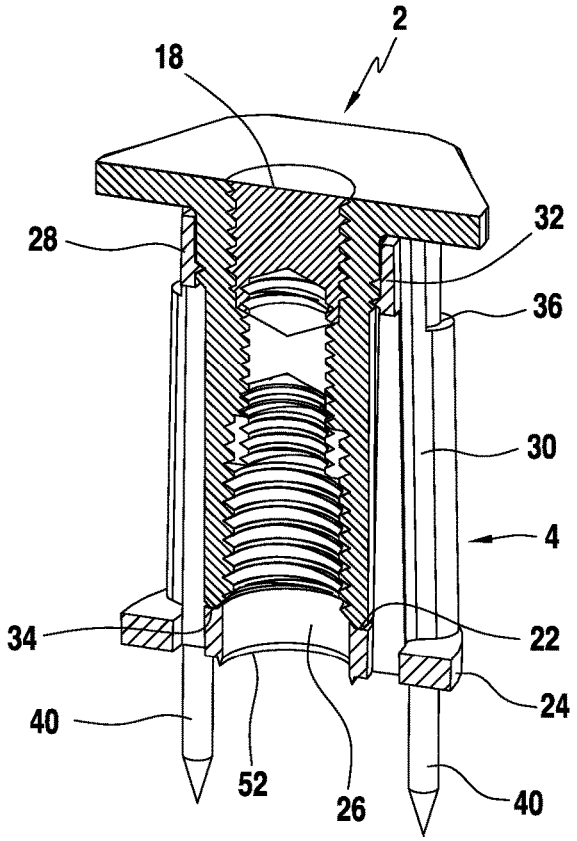
FIG. 3 is a cross-sectional perspective view of the concrete anchor assembly shown in FIG. 1.
Figure 4:
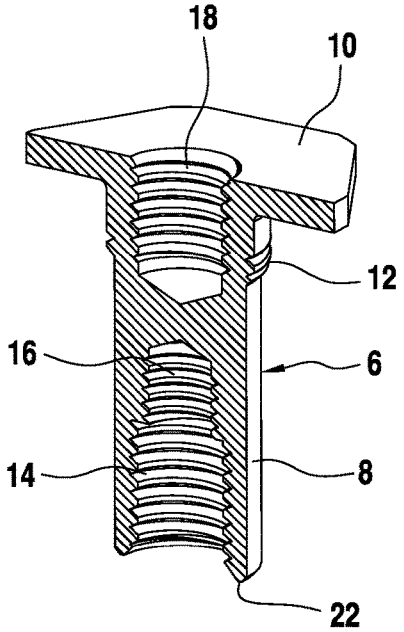
FIG. 4 is a cross-sectional perspective view of an anchor body used in the concrete anchor assembly shown in FIG. 1.

The concrete anchor assembly 2 comprises a holder 4 and an anchor body 6. The anchor body 6 includes a cylindrical rod portion 8 and a head portion 10 that extends outwardly of the cylindrical rod portion 8, as best shown in FIG. 3. Thread 12 is disposed at an upper end of the rod portion 8. The thread 12 is used to attach the anchor body 6 to the holder 4.

An internal threaded bore 14 is disposed at a bottom end of the rod portion 8. Another threaded bore 16 having a smaller diameter than the threaded bore 14 may be included above the threaded bore 14. Still another threaded bore 18 may be provided through the head portion 10. The threaded bores 14, 16 and 18 are preferably co-axial. The threaded bore 18 may be used to attach another anchor body, such as a threaded bolt, to increase the load capacity of the anchor body 6. The threaded bore 18 may also be used to attach a threaded rod, which is to be extended outside of the concrete mass, as for example disclosed in WO 2010/090748, hereby incorporated by reference. The threaded bore 18 preferably does not communicate with the threaded bores 14 and 16 to keep them sealed from the concrete slurry in case the threaded bore is not used. The smaller diameter threaded bore 16 may be used for lighter load with a smaller diameter threaded rod while the larger diameter threaded bore 14 may be used for larger diameter threaded rod for higher loads. The threaded rods are used to support loads, such as pipes hung from the ceiling of a concrete deck, anchor a wall section, etc.

Figure 5:
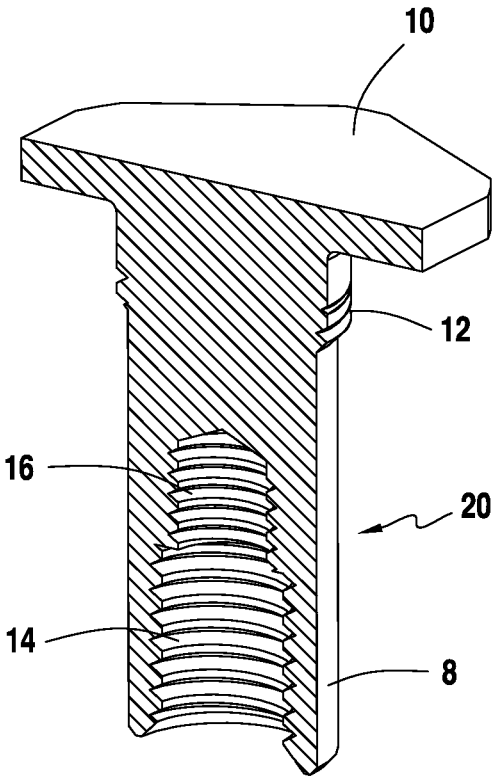
FIG. 5 is a cross-sectional perspective view of another embodiment of the anchor body shown in FIG. 4.

An anchor body 20 without the threaded bore 18 is shown in FIG. 5. All other features of the anchor body 20 are the same as those found in the anchor body 6 and are designated with like reference numerals.

The bottom edge 22 of the rod portion 8 is beveled to provide sealing contact against a confronting surface in the holder 4, as would be further explained below.

The anchor body 6 is embedded in concrete in such a way that the threaded bores 14 and 16 will be accessible for attachment of a threaded rod. The smaller threaded bore 14 or the larger threaded bore 16 may be used, depending on the load requiring a smaller or larger diameter threaded rod. The head portion 10 provides the anchoring function of the anchor body 6. For additional anchoring capacity, another anchor body, such as a standard bolt, may be attached to the threaded bore 18 prior to concrete pour. The threaded bore 18 may also be used to attach a threaded rod prior to concrete pour to support a load in the opposite direction from the load that may be supported by the threaded bore 14 or 16.

The holder 4 advantageously positions the anchor body 6 on a wood formboard such that after the concrete has cured and the formboard is removed, threaded bores 14 and 16 are accessible for attaching a threaded rod. See, for example, U.S. application Ser. No. 13/424,082.

Figure 1:
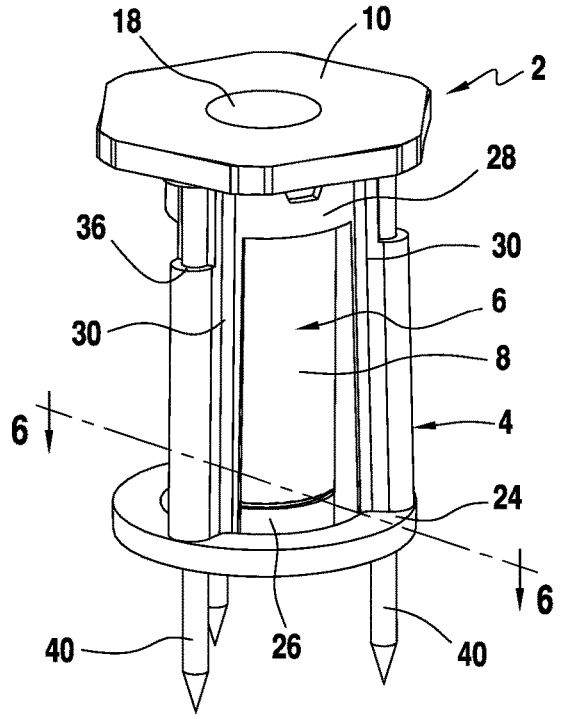
FIG. 1 is a top perspective view of a concrete anchor assembly embodying the present invention.
Figure 2:
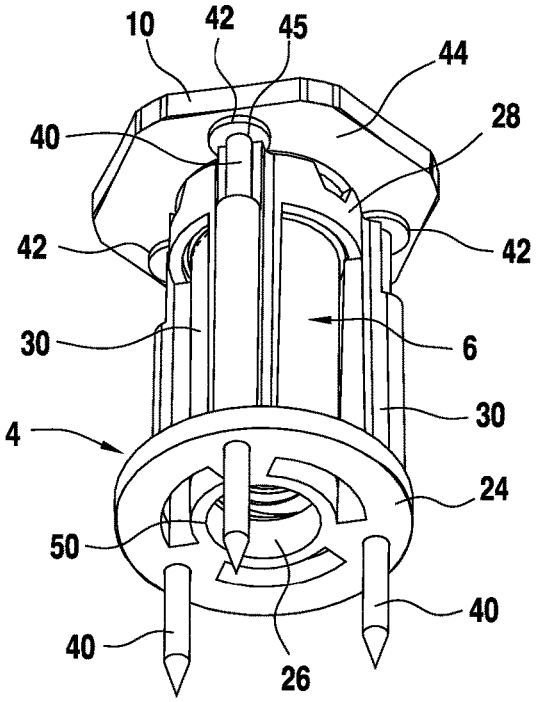
FIG. 2 is bottom perspective view of FIG. 1.

Referring to FIGS. 1-3, the holder 4 includes a base portion 24, a plug portion 26, a sleeve portion 28 and a plurality of post portions 30. The post portions 30 connect the base portion 24 to the sleeve portion 28. The plug portion 26 is in the form of a sleeve with an opening coaxial with the opening of the sleeve portion 28.

Referring to FIG. 3, the sleeve portion 28 includes inside thread 32 that cooperate with the outside thread 12 of the anchor body 6 to thereby secure the anchor body 6 to the holder 4. The thread 32 may be a single turn and segmented thread. The bottom edge 22 of the rod portion 8 engages a confronting top edge 34 of the plug portion 26 to provide a seal to prevent entry of the concrete slurry into the bores 14 and 16 during concrete pour.

Figure 6:
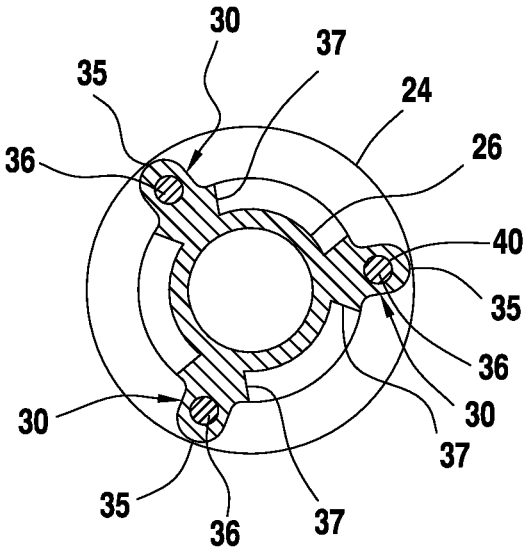
FIG. 6 is a cross-sectional view taken along line 6-6 in FIG. 1.

Referring to FIG. 6, the post portions 30 include respective vertical openings 36 for receiving respective nails 40 that are used to attach the holder 4 to the formboard. The post portions 30 further include respective tubular portions 35 with the openings 36 and base portions 37 connecting the sleeve portion 28 and the plug portion 26. The tubular portions 35 are attached to the respective base portions 37. The nails 40 extend downwardly from the base portion 24. The nail heads 42 are advantageously in direct contact with the bottom surface 44 of the head portion 10 of the anchor body 6, shown in FIG. 2, so that driving force applied to the head portion 10 is transmitted directly to the nail heads 42.

Preferably, three nails are used for stability during installation, but a different number may be used. The nails may or may not be pre-installed in the holder. The nails may be provided separate from the holder so that an installer will have to insert the nails in the respective holes prior to installation.

Figure 7:
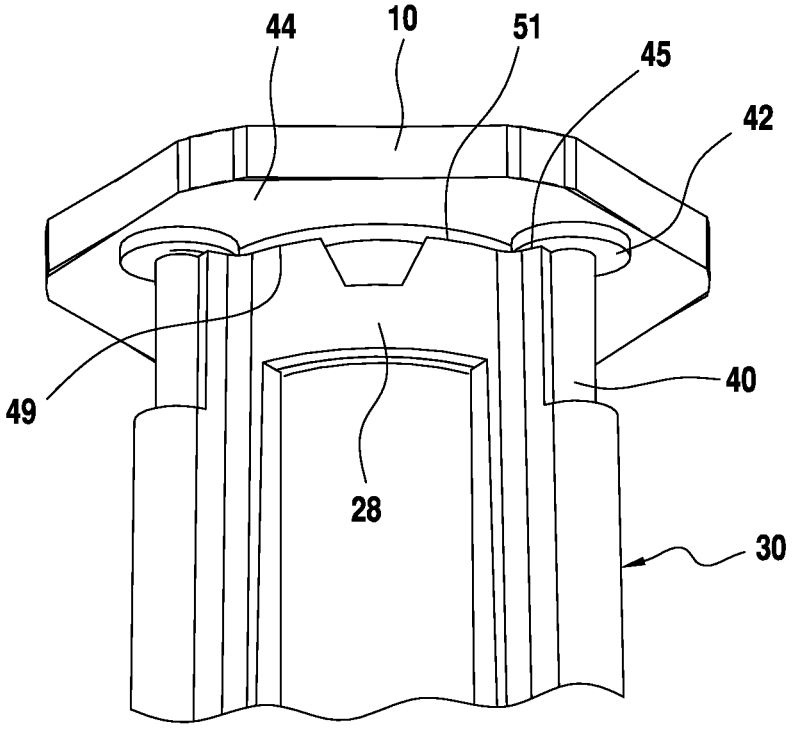
FIG. 7 is an enlarged fragmentary view of a portion of FIG. 2.

Referring to FIG. 7, the post portions 30 have respective top edges 45 that engage the undersides of the respective nail heads 42, providing a shoulder as a stop to always keep the nail head 42 in direct contact with the bottom surface 44 of the head portion 10. The top edges 45 are preferably in line with the top edge 49 of the sleeve portion 28 so that a gap 51 substantially equal to the thickness of the nail heads 42 is maintained between the bottom surface 44 and top edge 49. This advantageously insures that the bottom surface 44 is directly in contact with the nail head 42.

The concrete anchor assembly 2 is attached to the wood formboard by hammering the head portion 10. The hammering forces are then transmitted to the nail heads 42 by virtue of direct contact of the nail heads 42 with head portion 10, thereby driving the nails 40 into the formboard. Providing the concrete anchor assembly 2 complete with holder, anchor body and attaching nails in one package advantageously makes for an efficient installation.

Figure 8:
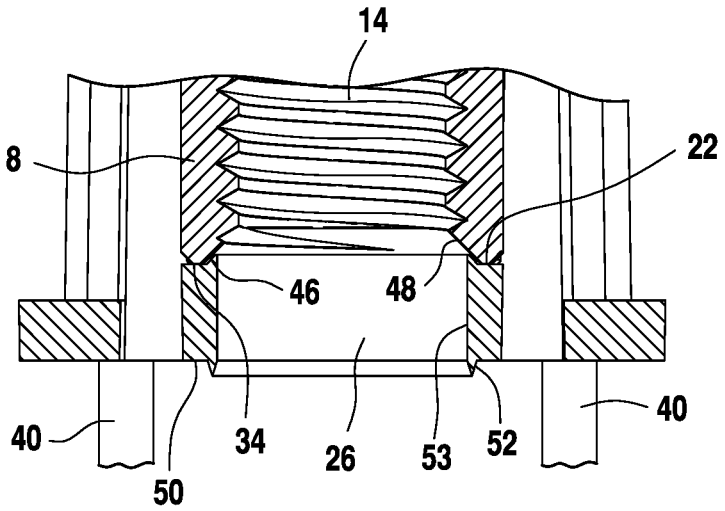
FIG. 8 is an enlarged cross-sectional view of the lower portion of FIG. 3, showing a sealing feature.

Referring to FIG. 8, the top edge 34 of the plug portion 26 includes a ramp surface 46 that engages a beveled surface 48 on the bottom edge of the rod portion 8. Contact between the surfaces 46 and 48 advantageously reduces entry of the concrete slurry between the bottom edge 22 of the anchor body 6 and the top edge 34 of the plug portion 26 during a concrete pour.

The bottom surface 50 of the plug portion 26 includes a circumferential V-shaped projection 52 disposed around the opening 53 that digs into the formboard surface when the concrete assembly 2 is installed, thereby sealing the bores 14 and 16 from the concrete slurry during concrete pour.

Figure 9:
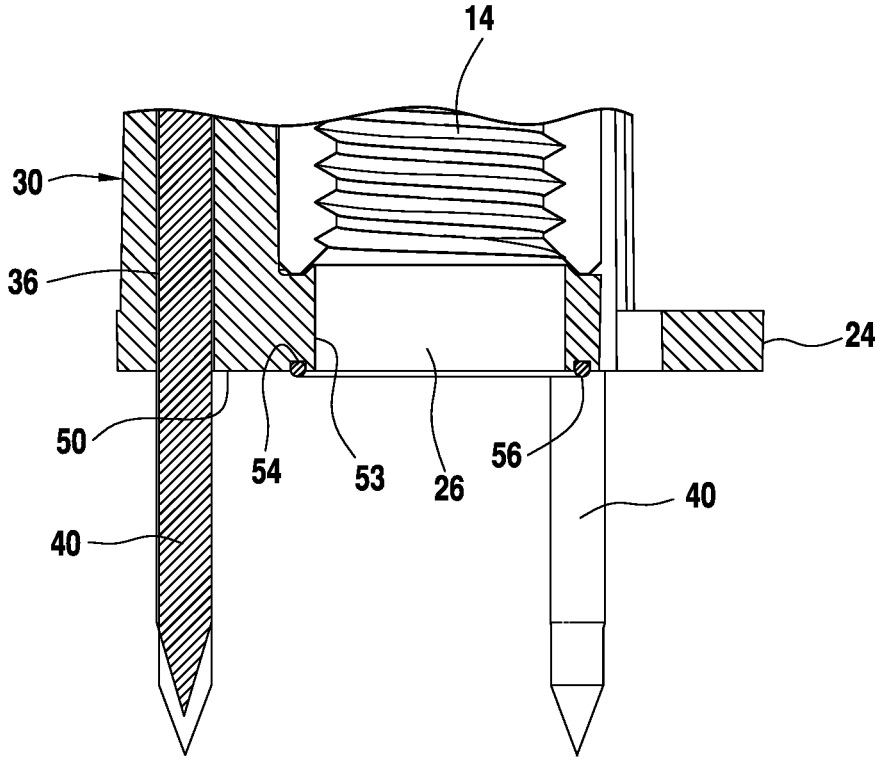
FIG. 9 is another embodiment of the sealing feature shown in FIG. 8.
Figure 10:
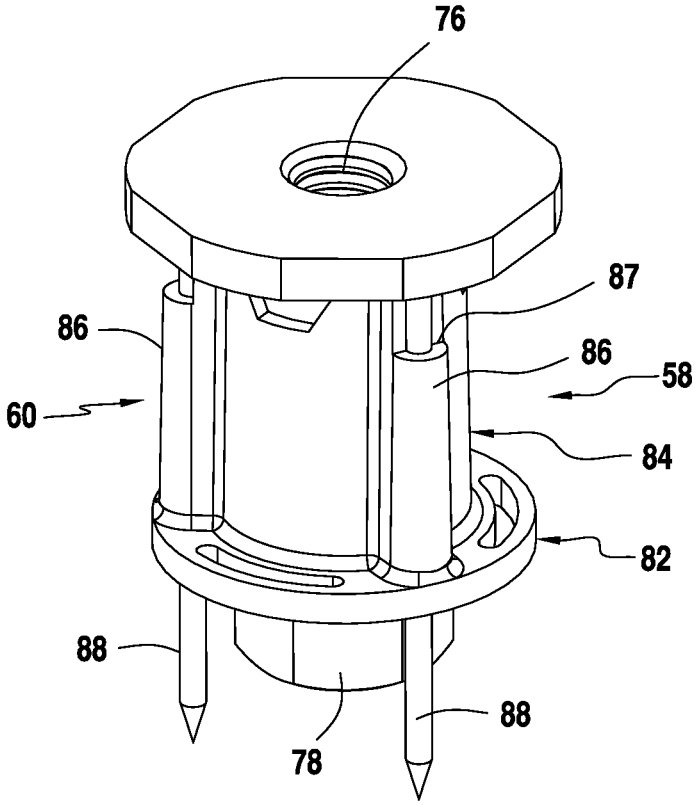
FIG. 10 is a perspective view of another embodiment of a concrete anchor assembly embodying the present invention.

Referring to FIG. 9, the projection 52 may be replaced with an O-ring 54 disposed in a groove 56 on the bottom edge 50 of the plug portion 26. The O-ring 54 is configured to seal the opening 53 from the concrete slurry.

Another embodiment of a concrete anchor assembly 58 is disclosed in FIGS. 10-13. The assembly 58 includes a holder 60 and an anchor body 62. The anchor body 62 includes a rod portion 64 and a head portion 66. The rod portion 64 includes outside threads 68 and 70. The outside thread 68 is preferably larger in diameter than the outside thread 70. The anchor body 62 also includes inner threaded bores 72 and 74. The inner threaded bore 74 is advantageously larger in diameter than the threaded bore 72.

The head portion 66 may include a threaded bore 76 for connection to another anchor body, such as a standard bolt, or to a threaded rod for connection to a load outside the concrete mass in which the anchor assembly 58 is embedded. A nut 78 may be attached to the anchor body 62 via the outside thread 70 and the inside thread 71 after the concrete has cured and the formboard to which the anchor assembly 58 was attached has been removed, thereby making accessible the outside thread 70. The nut 78 includes another thread 80 having a diameter larger than the diameter of the inner thread 74. The use of the nut 78 gives the anchor body 62 the capability to accept one of three different sized threaded rods. This gives the anchor assembly 58 maximum flexibility for supporting different loads requiring different diameter threaded rods from the anchor body 62.

The head portion 66 extends outwardly and transversely from the rod portion 64 to provide the anchorage function within the concrete mass in which the anchor assembly 58 is embedded.

Referring back to FIG. 10, the holder 60 includes a base portion 82, a sleeve portion 84 connected to the base portion 82 and post portions 86 including vertical openings 87 for receiving and vertically positioning respective nails 88.

Referring back to FIGS. 11 and 13, the sleeve portion 84 includes an upper portion 90 with internal thread 92 that engage the outside thread 68 on the anchor body 62. The sleeve portion 84 also includes a lower portion 94 with an internal diameter adapted to receive the nut 78 when attached to the anchor body 62. The lower portion 94 may include an inside diameter larger than the inside diameter of the upper portion 90 if needed to accommodate the nut 78.

Figure 12:
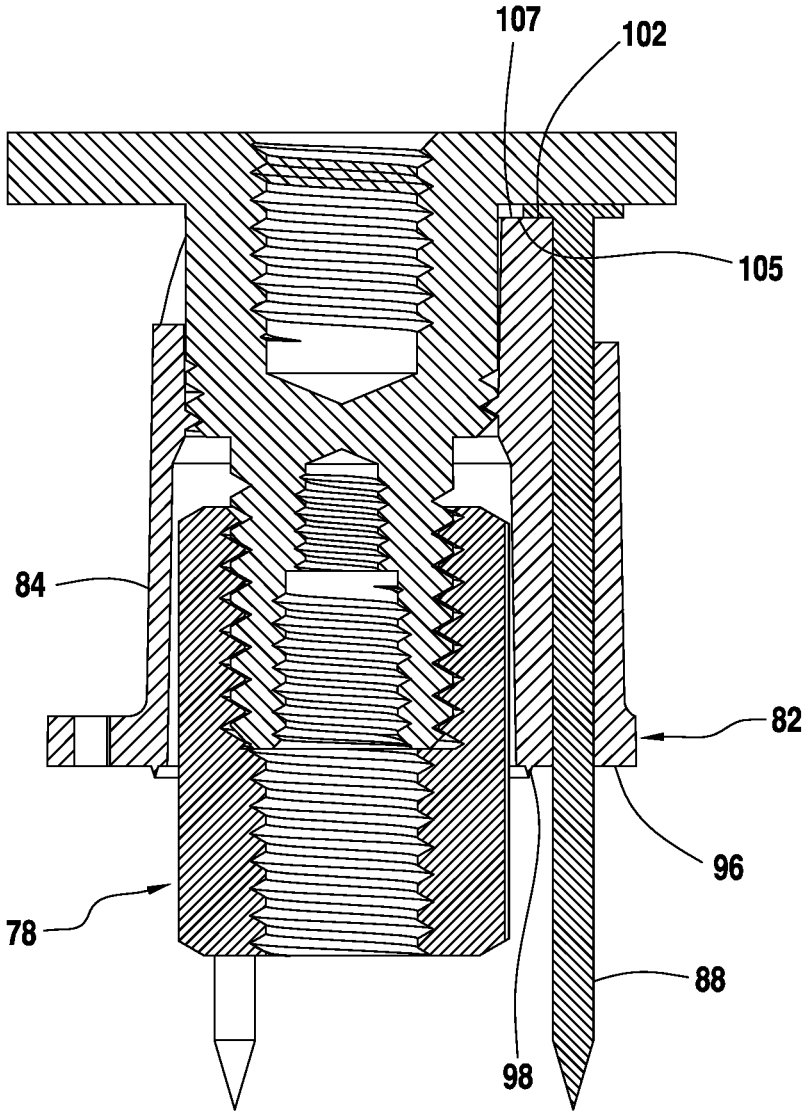
FIG. 12 is an elevational cross-sectional view of FIG. 11.
Figure 13:
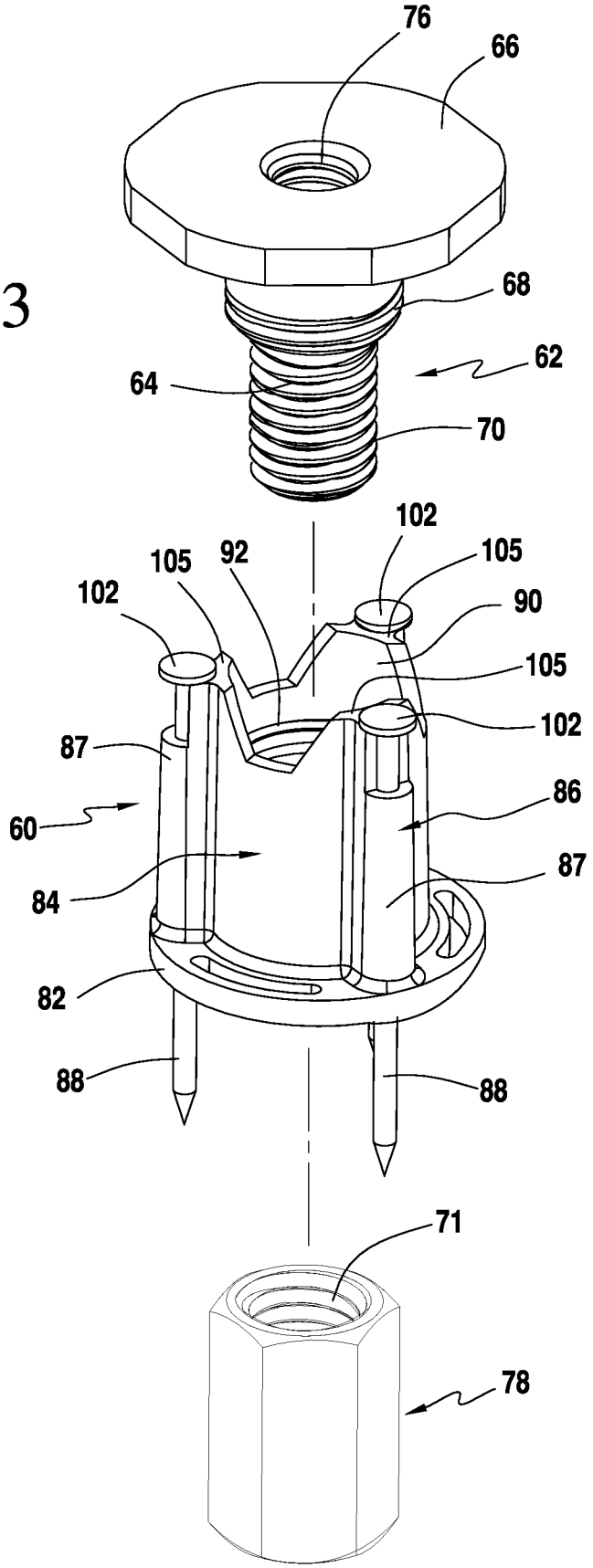
FIG. 13 is an assembly view of FIG. 10.

Referring to FIG. 12, the base portion 82 includes a bottom surface 96 with a V-shaped projection 98 around the peripheral edge of the opening 100 of the sleeve portion 84. The projection 98 extends downwardly from the bottom surface 96 such that when the assembly 58 is attached to the formboard (without the nut 78), the projection 98 will be depressed into the wood formboard, thereby to seal the opening 100 from the concrete slurry during concrete pour.

Figure 11:
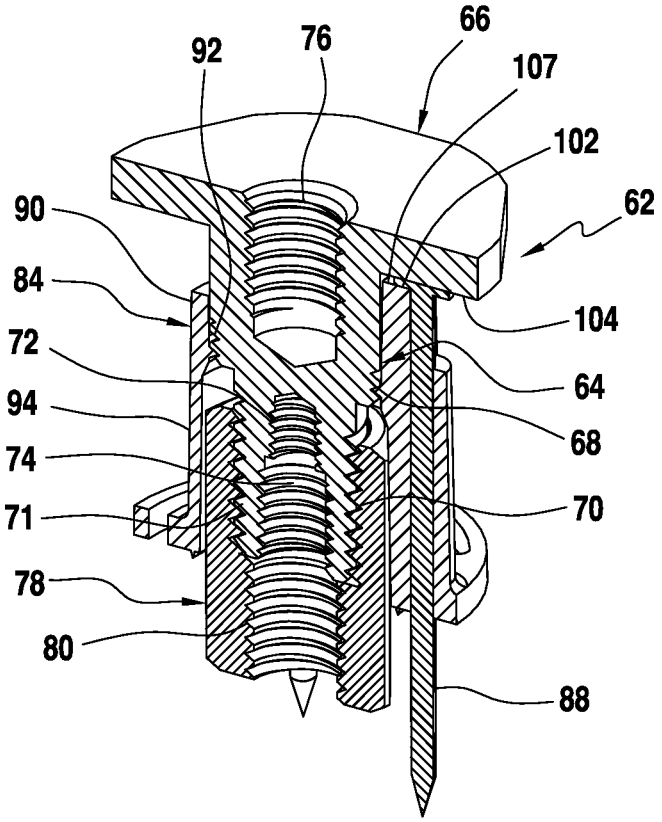
FIG. 11 is a perspective longitudinal cross-sectional view of FIG. 10.

Referring to FIG. 11, each of the nails 88 includes a nail head 102 that is in direct contact with an underside 104 of the head portion 66. Top surfaces 105 provide respective stops for the nail heads 102 so that when the anchor body 62 is screwed into the holder 60, the underside 104 will contact the nail heads 102. A gap 107 substantially equal to the thickness of the nail heads 102 is maintained between the top surfaces 105 and the underside 104 to ensure that hammer blows to the head portion 66 are transmitted directly to the nail heads 102 to efficiently drive the nails 88 into the formboard. The nut 78 will normally not be attached to the anchor body 62 when attaching the anchor assembly 58 to the formboard. A person of ordinary skill in the art would appreciate that directly hammering on the nail heads 102, with the anchor body 62 out of the way, may also be used in attaching the holder 60 to the formboard. The placement of the nail heads 102 on the stops 105 advantageously makes the nail heads 102 visible throughout the time the holder 60 is being attached to the formboard.

Figure 14:
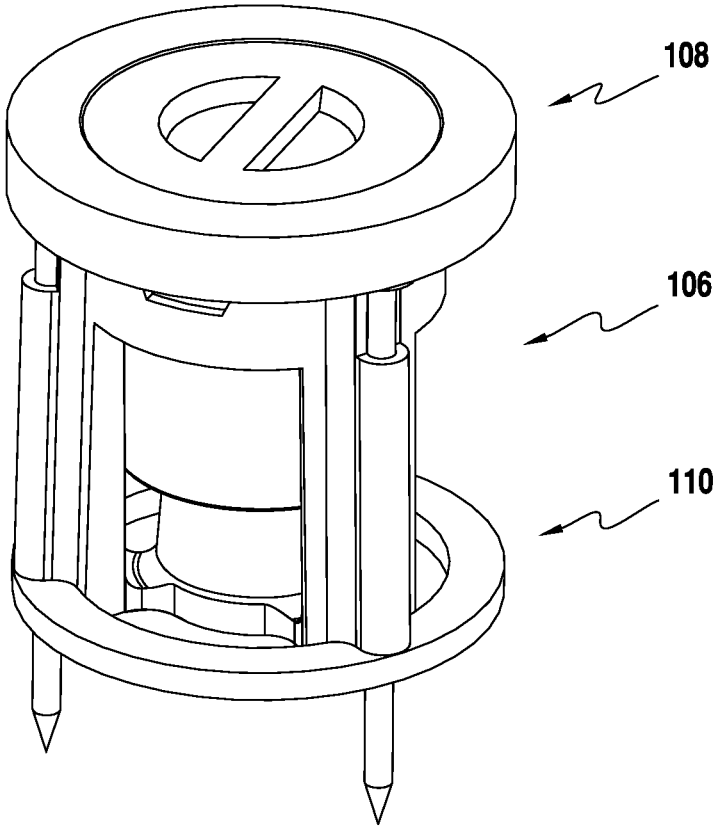
FIG. 14 is a perspective view of another embodiment of a concrete anchor assembly embodying the present invention.
Figure 15:
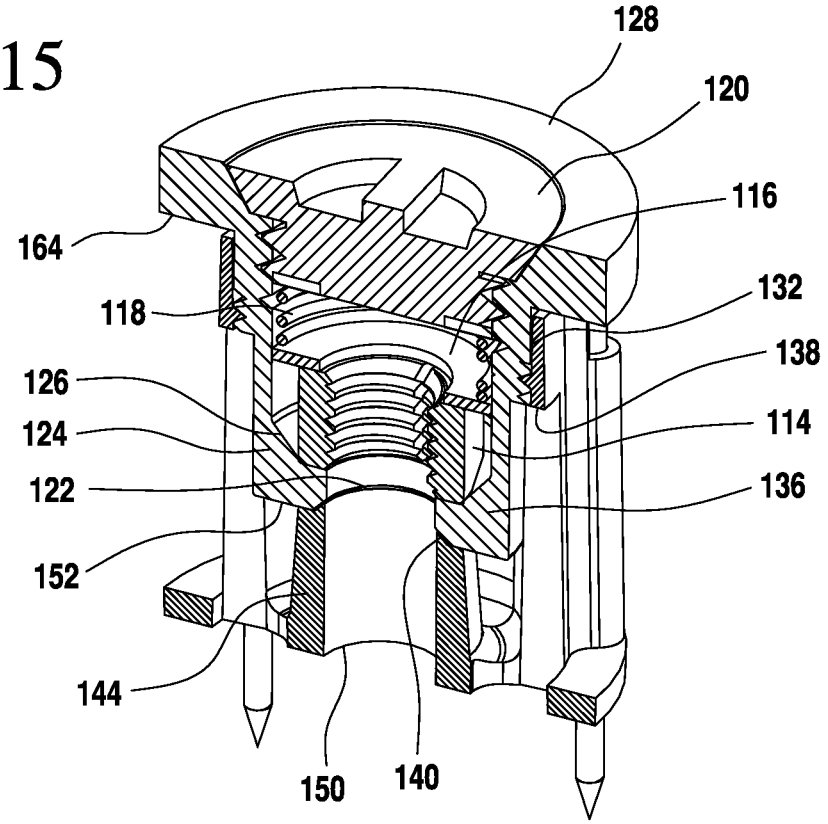
FIG. 15 is a perspective longitudinal cross-sectional view of FIG. 14.
Figure 16:
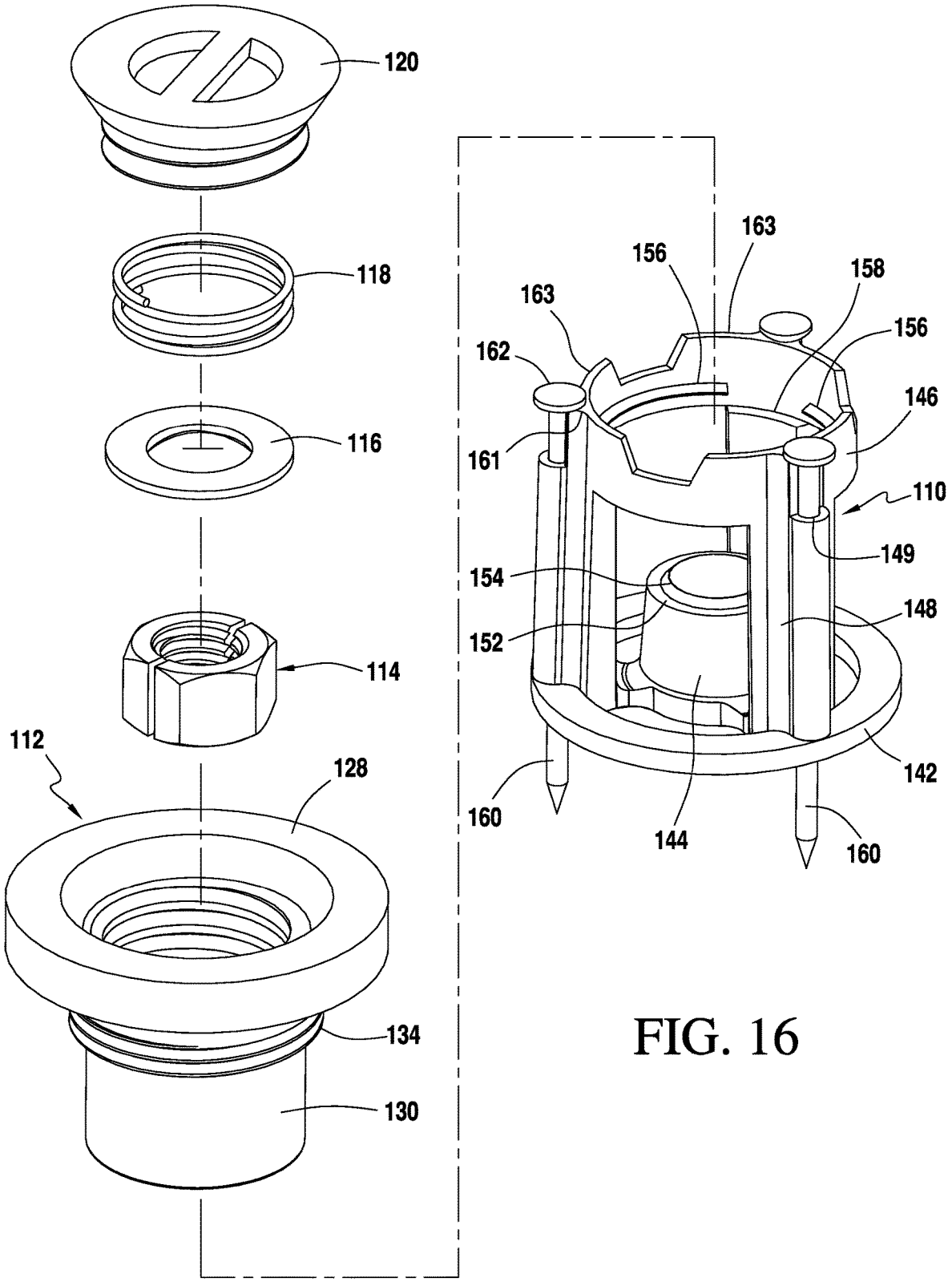
FIG. 16 is an assembly view of FIG. 14.

Referring to FIGS. 14-16, another embodiment of a concrete anchor assembly 106 is disclosed. The concrete anchor assembly 106 includes an anchor body assembly 108 and a holder 110. The anchor body assembly 108 includes a housing 112, a split nut 114, a washer 116, a spring 118 and a cap 120.

The housing 112 has an opening 122 and a bottom wall 124 for supporting the split nut 114. The bottom wall 124 has an internal ramp surface 126 on which the split nut 114 will rise up when a threaded rod is axially forced into the split nut 114 through the opening 122. The cover 122 is threaded into the housing 112 to bias the spring 118 against the washer 116 to thereby bias or force the split nut 114 unto the bottom of the ramp surface 126. The housing 112 includes a circumferential flange portion 128 that extends outwardly and transversely from a vertical cylindrical wall portion 130 of the housing 112. The flanged portion 128 provides the anchorage function of the anchor assembly 106 when embedded in concrete.

The wall portion 130 has an upper cylindrical portion 132 provided with thread 134. A lower portion 136 of the wall portion 130 may be of a smaller diameter than the upper wall portion 132 such that a shoulder 138 is created.

The bottom peripheral edge of the opening 122 includes a bevel surface 140 that mates with a corresponding surface on the holder 110.

The holder 110 includes a base portion 142, a plug portion 144 attached to the base portion 142, a sleeve portion 146 and a plurality of post portion 148 with vertical openings 149. The plug portion 144 includes an opening 150 that lines up with the opening 122 in the housing 112. The bottom peripheral edge of the opening 150 may include the projection 52 or the O-ring 54 to seal the interior of the plug portion 144 from the concrete slurry during concrete pour. A top edge 152 of the plug portion 144 includes a beveled surface 154 that mates with the corresponding beveled surface 140 on the housing 130 to provide sealing contact to minimize or prevent entry of the concrete slurry into the housing 130 during concrete pour. The sleeve portion 146 includes a single turn segmented thread 156 for cooperating with the thread 134 on the housing 112. Shoulders 158 at a bottom portion of the sleeve portion 146 are provided as a stop to engage the shoulder 138 on the housing 112 when the housing 112 is screwed into the holder 110. The vertical openings 149 locate the nails 160 vertically. The nail heads 162 extend over the top edge 161 of the post portions 148 that act as stops for the nail head 162. The top edges 161 preferably are on the same level as the top edges 163 of the sleeve portion 146 such that the top of the nail heads will always engage the undersurface 164 of the flanged portion 128. With this arrangement, the nail heads 162 will be in direct contact with flange portion 128 when the housing 112 is screwed into the holder 110.

To attach the assembly 106 to a formboard, the cap 120 is struck with a hammer, whereby the impact forces are transmitted to the nail heads 162, which are in direct contact with the underside 164 of the flanged portion 128. The anchor assembly 106 may also be attached to the formboard by removing the anchor body assembly 108 from the holder 110, thereby exposing the nail heads 162, which are struck by a hammer to drive the nails 160 into the formboard. Positioning the nail heads 162 on the top edges 161 insures that the nail heads 162 will remain exposed above the sleeve portion 146 during installation.

Another embodiment of a concrete anchor assembly 166 is disclosed in FIGS. 17-21. The assembly 166 includes an anchor body assembly 168 and a holder 170.

The anchor body assembly 168 includes a housing 172, a split nut 174, a washer 178, a spring 180, a washer 182 and a C-shaped spring clip 184.

The housing 172 includes a bottom wall 186 with a ramp surface 188 on which the split nut 174 rises upwardly when a threaded to be attached to the split nut 174 is pushed upwardly through an opening 190 after the concrete has cured, the formboard is removed to expose the holder 170 and the holder is removed. The spring clip 184 is disposed in a groove 192 inside the housing 172. The spring 180 is under tension to urge the split nut 174 towards the bottom of the ramp surface 188.

The housing 172 has cylindrical wall 187 with a circumferential flange portion 206 that extends outwardly transversely from the wall 187.

The holder 170 includes a base portion 194 and a threaded projection 196 that attaches to the split nut 174. A plurality of nails 200 are carried by the base portion 194 through respective vertical holes 202. The nails 200 extend vertically downwardly from the base portion 194. The nail head 204 are advantageously disposed underneath the bottom wall 186 and are in direct contact therewith so that hammer blows to the circumferential flange portion 206 are transmitted directly to the nails heads 204 thereby to drive the nails 200 into the formboard, which forms part of the concrete form. After the concrete dries, the formboard is removed, exposing the bottom of the base portion 194 and the protruding nails 200. A rib member 208 and recesses 210 advantageously allow a rotary powered tool, such as a drill with a yoke bit, to engage the rib member 208 and unscrew the holder 178 and remove it from the split nut 174.

The housing 172 has a top opening 212 which may be closed off by a tape 214 or other standard means.

Figure 21:
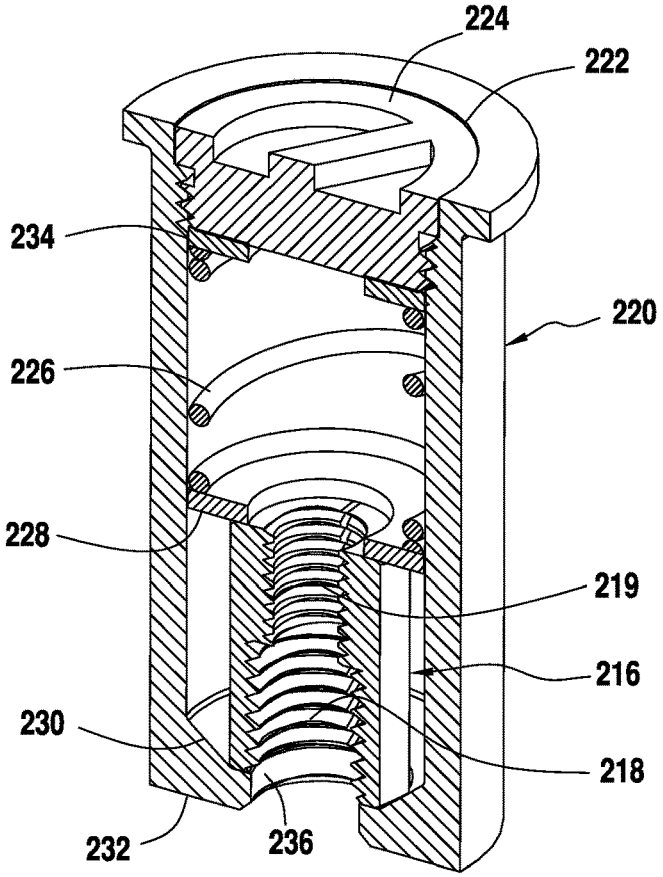
FIG. 21 is a perspective longitudinal cross-sectional view of another embodiment similar to FIG. 17.

A split nut 216 with different diameter threads 218 and 219 is disclosed in FIG. 21. The split nut 216 allows for the use of different diameter threaded rods as may be dictated by the load for a particular application. The split nut 216 is disposed within the housing 220 with the top opening 222 closed off by a cover 224. The opening 222 is used for assembling the components within the housing 220. A spring 226 urges the split knot 216 via washer 228 at the bottom of a ramp surface 230 on a bottom wall 232 of the housing 220. A washer 234 may be used to facilitate the turning of the cover 224 when closing the opening 222.

When a threaded rod is axially pushed into the opening 236 at the bottom wall 232, the split nut will be pushed up on the ramp surface 230, further compressing the spring 226 and enlarging the threaded openings 218 and 219. When the upward force on the threaded rod ceases, the spring 226 will force the split nut downwardly along the ramp surface 230 to thereby close around and engage the thread of the threaded rod.

Further, the various features described in one embodiment may be applied to the other holder embodiments disclosed herein.

Figure 22:
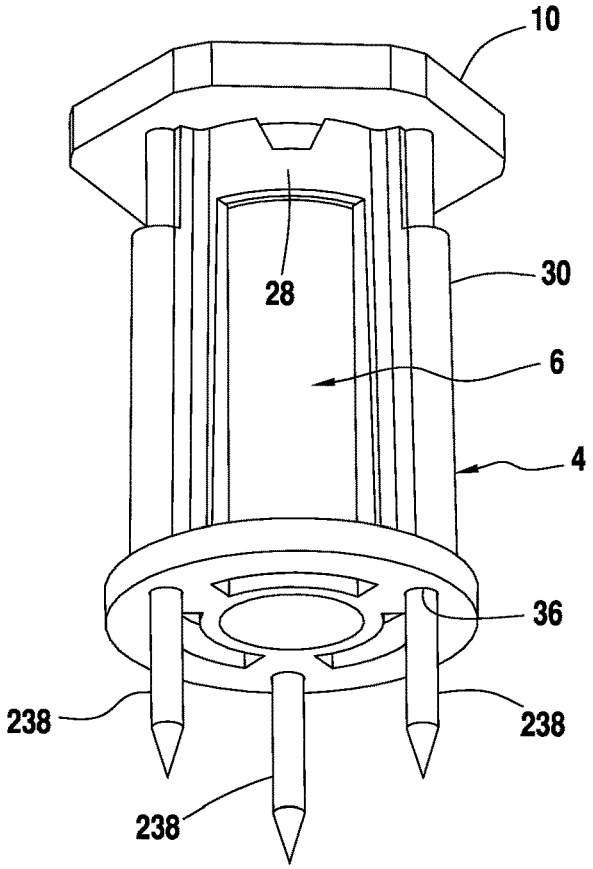
FIG. 22 is a perspective view of another embodiment of the concrete anchor assembly shown in FIG. 1.

Referring to FIG. 22, the nail heads 42 shown in FIG. 2 may be removed, leaving the nails 40 with only the shafts 238 showing. The nail shafts 238 may be secured to the underside of the head portion 10, if needed, by glue, welding, or other standard means. In this embodiment, force applied to the head portion 10 is transmitted directly to the nail shafts 238. The threads 12 on the anchor body 6 or 20 and the inside threads 32 in the sleeve 28 may be eliminated in this embodiment. The nail shafts 238 are frictionally held in the vertical openings 36 of the post portions 30 as shown in FIG. 9. The sleeve 28 may also be frictionally attached to the rod portion 8 of the anchor body 6 or 20.

Figure 23:
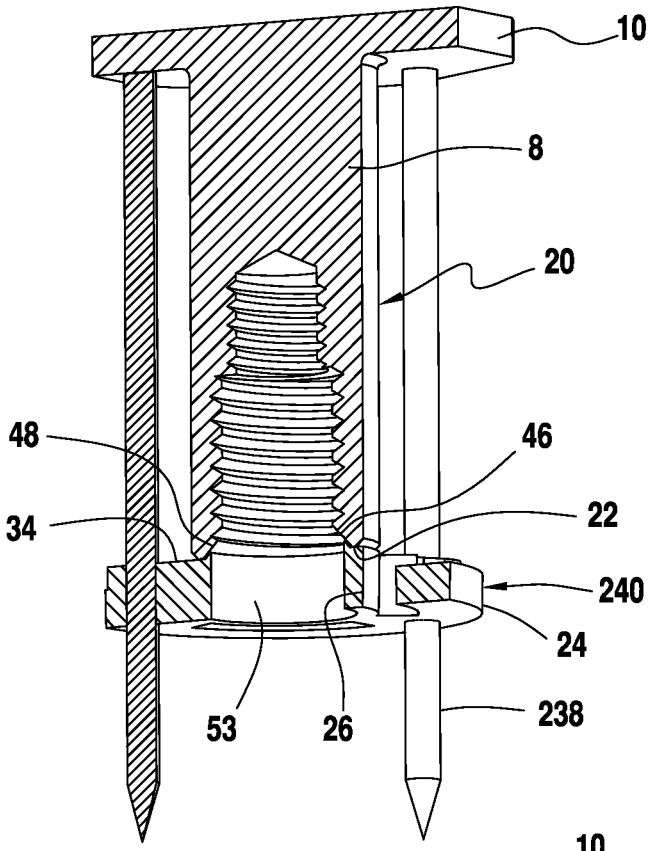
FIG. 23 is a perspective cross-sectional view of an embodiment of the concrete anchor assembly shown in FIG. 22.

Referring to FIG. 23, the embodiment of FIG. 22 is further modified. An embodiment of a holder 240 is disclosed. The holder 240 is similar to the holder 4 disclosed above except that the holder 240 only includes the base portion 24 and the plug portion 26 of the holder 4. The holder 240 includes the plug portion 26 with the central opening 53. The top edge 34 of the plug portion 26 includes a ramp surface 46 that engages a beveled surface 48 on the bottom edge of the rod portion 8. Contact between the surfaces 46 and 48 advantageously reduces entry of the concrete slurry between the bottom edge 22 of the anchor body 6 and the top edge 34 of the plug portion 26 during a concrete pour. As in the embodiment of the concrete anchor assembly 2, the nail shafts 238 protrude through the base portion 24. The nail shafts 238 are frictionally attached to the base portion 24 to hold the holder 240 to the anchor body 20. It should be understood that embodiment of FIG. 23 may also include the threaded bore 18 shown in FIG. 4.

Figure 24:
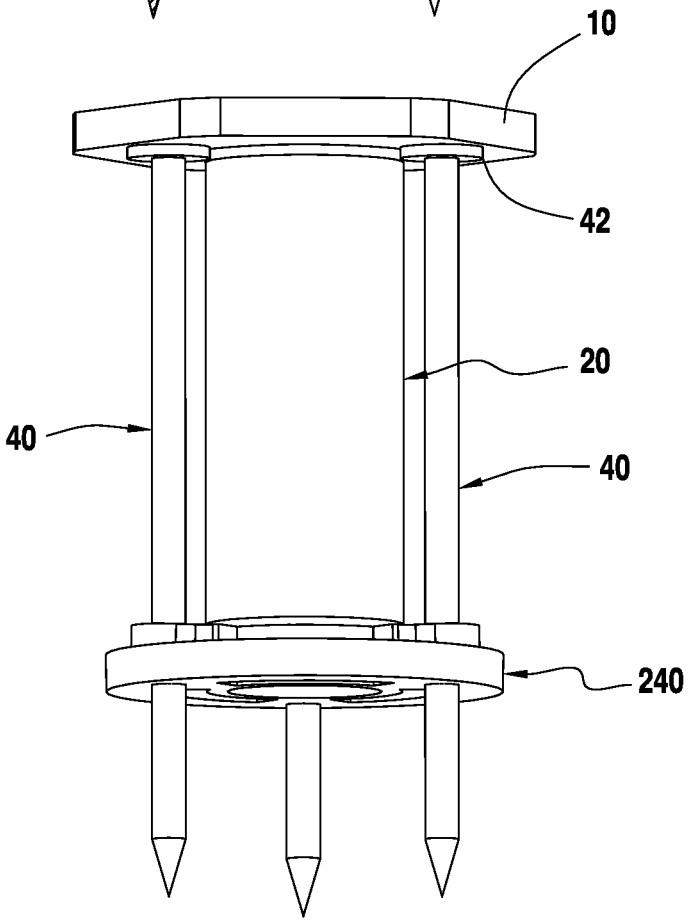
FIG. 24 is a perspective view of another embodiment of the concrete anchor assembly shown in FIG. 23.

Referring to FIG. 24, the embodiment shown in FIG. 23 is further modified. The nails 40 include respective heads 42, which may be attached to the underside of the head portion 10, if needed, by glue, welding, or other standard means.

It should be understood by a person skilled in the art that the various features described in one embodiment may be applied to the other embodiments disclosed herein.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A concrete anchor assembly, comprising:

a) a housing including an opening and a side wall, the side wall including an upper end portion; b) a flange portion extending outwardly from the upper end portion of the side wall;

c) a ramp surface extending upwardly around the lower opening;

d) a split body disposed over the opening, the split body including a surface engaging the ramp surface, the split body including a threaded opening;

e) the housing including a gap between the split body and the side wall; and f) a spring to force the split body toward a bottom of the ramp surface.

2. A concrete anchor assembly as in claim 1, wherein the housing is cylindrical.

3. A concrete anchor assembly as in claim 1, and further comprising a plug inside the opening.

4. A concrete anchor assembly as in claim 1, wherein the threaded opening has multiple diameters.

5. A concrete anchor assembly as in claim 1, wherein the split body is a split nut.

6. A concrete anchor assembly as in claim 1, wherein the housing includes an upper opening covered with a tape.

7. A concrete anchor assembly as in claim 1, wherein the housing includes an upper opening with a threaded cover.

8. A concrete anchor assembly as in claim 1, and further comprising:

a) a first washer disposed on the split body inside the housing; and b) the spring is disposed above the first washer.

9. A concrete anchor assembly as in claim 8, and further comprising:

a) a second washer operably attached to an upper portion of the housing; and b) the spring is disposed between the first washer and the second washer.

10. A concrete anchor assembly as in claim 9, and further comprising:

a) a spring clip operably attached to the side wall inside housing;

b) the spring clip is disposed above the second washer to hold the second washer against the spring.

11. A concrete anchor assembly as in claim 10, wherein:

a) the side wall includes a circumferential groove in the side wall inside the housing; and b) the spring clip is disposed inside the circumferential groove.

12. A concrete anchor assembly as in claim 1, wherein the flange portion is circumferential around the housing.

13. A concrete anchor assembly as in claim 3, wherein:

a) the plug includes a base portion; and b) the housing is disposed on the base portion.

14. A concrete anchor assembly as in claim 13, and further comprising a nail extending through the base portion.

15. A concrete anchor as in claim 1, and further comprising a holder for the housing.

16. A concrete anchor assembly as in claim 15, wherein:

a) the housing includes outside threads; and b) the holder includes an opening with inside threads mated to the outside threads.

17. A concrete anchor assembly, comprising:

a) a plug having a plug portion and a base portion attached to the plug portion, the base portion for attachment to a form board prior to pouring of concrete;

b) a hollow anchor body operably attached to the plug portion, the hollow anchor body including an opening and a side wall, the hollow anchor body including a ramp surface extending upwardly around the opening, the hollow anchor body including a flange portion extending from an upper end portion of the side wall;

c) a split body disposed over the opening, the split body including a surface engaging the ramp surface, the split body including a threaded opening;

d) the hollow anchor body including a gap between the split body and the side wall; and e) a spring to force the split body toward a bottom of the ramp surface.

18. A concrete anchor assembly as in claim 17, wherein:

a) the base includes a peripheral edge; and b) openings disposed along the peripheral edge to receive screws or nails for attaching the base to the form board.

19. A concrete anchor assembly as in claim 17, wherein the split body includes multiple threaded bores of differing diameters.

20. A concrete anchor assembly as in claim 17, wherein the split body is a split nut.

* * * * *